US009161618B2

(12) United States Patent
Wilson

(10) Patent No.: US 9,161,618 B2
(45) **Date of Patent: *Oct. 20, 2015**

(54) TRAY DEVICE WITH DOCKING STATION

(71) Applicant: Megan Streit Wilson, Evergreen, CO (US)

(72) Inventor: Megan Streit Wilson, Evergreen, CO (US)

(73) Assignee: Bambinos!, LLC, Evergeeen, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/455,720

(22) Filed: Aug. 8, 2014

(65) Prior Publication Data

US 2014/0345499 A1 Nov. 27, 2014

Related U.S. Application Data

(63) Continuation-in-part of application No. 13/336,625, filed on Dec. 23, 2011, now Pat. No. 8,820,548.

(60) Provisional application No. 61/445,820, filed on Feb. 23, 2011.

(51) Int. Cl.

| | |
|---|---|
| ***A47B 85/00*** | (2006.01) |
| ***A47B 23/04*** | (2006.01) |
| ***A47B 13/14*** | (2006.01) |
| ***A47D 1/00*** | (2006.01) |
| ***A47D 3/00*** | (2006.01) |
| ***A47G 19/10*** | (2006.01) |

(52) U.S. Cl.

CPC ..... *A47B 23/04* (2013.01); *A47B 13/14* (2013.01); *A47D 1/008* (2013.01); *A47D 3/00* (2013.01); *A47G 19/10* (2013.01)

(58) Field of Classification Search

CPC ..... A47B 13/16; A47B 37/00; A47B 96/061; A47B 96/063; A47B 9/065; A47B 9/066; F16B 2/12

USPC ..... 108/25, 26, 152, 42, 90; 297/135, 297/174 R, 174 CS, 147; 248/228.3, 228.5, 248/228.6, 230.6, 231.71; 211/88.01, 211/94.01, 126.1, 133.6, 162

See application file for complete search history.

(56) References Cited

U.S. PATENT DOCUMENTS

| | | | |
|---|---|---|---|
| 126,374 | A | 5/1872 | Bonington |
| 402,788 | A | 5/1889 | Wagandt |
| 1,242,785 | A | 10/1917 | Eldridge |
| 1,983,138 | A | 12/1934 | Lehman |
| 2,024,667 | A | 12/1935 | Stinson |

(Continued)

FOREIGN PATENT DOCUMENTS

GB 2095988 A 10/1982

OTHER PUBLICATIONS

European Search Report Application No. EP 11 85 9488 Completed: Jan. 22, 2015; Mailing Date: Jan. 29, 2015 10 pages.

*Primary Examiner* — Jose V Chen

(74) *Attorney, Agent, or Firm* — St. Onge Steward Johnston & Reens LLC

(57) ABSTRACT

A tray device that is detachably connectable to a surface, such as a table surface, providing an eating and/or playing surface for a child. The tray is provided with a lip that extends upwardly and outwardly toward the child's body so as to catch items and/or food or drink dropped by the child and direct the slipped item onto the tray surface. The tray may also be provided with a removable insert and various attachment mechanisms to firmly hold the tray onto the table surface.

12 Claims, 13 Drawing Sheets

(56) References Cited

U.S. PATENT DOCUMENTS

| | | | | | |
|---|---|---|---|---|---|
| 2,530,736 | A | | 11/1950 | Sheldon | |
| 2,766,455 | A | | 10/1956 | Klaine | |
| 2,867,401 | A | * | 1/1959 | Sheahan | 297/135 |
| 2,935,209 | A | | 5/1960 | Fritz | |
| 3,148,636 | A | * | 9/1964 | Blomquist et al. | 108/26 |
| 3,249,070 | A | * | 5/1966 | Day et al. | 108/26 |
| 3,476,257 | A | | 11/1969 | O'Connell | |
| 4,003,598 | A | | 1/1977 | Glaze | |
| 4,105,247 | A | | 8/1978 | Saint | |
| 4,723,813 | A | | 2/1988 | Kassai | |
| 4,942,827 | A | * | 7/1990 | Norgaard | 297/135 |
| 5,156,096 | A | * | 10/1992 | Lamprey | 108/152 |
| 5,209,370 | A | | 5/1993 | Pickett et al. | |
| D347,360 | S | | 5/1994 | Wheeler | |
| 5,887,940 | A | * | 3/1999 | Anderson et al. | 297/135 |
| 5,893,331 | A | * | 4/1999 | Diletto | 297/135 |
| 6,021,521 | A | | 2/2000 | Baratta | |
| 6,062,640 | A | | 5/2000 | Stahl | |
| 6,128,781 | A | | 10/2000 | Spindler | |
| 6,273,503 | B1 | * | 8/2001 | Cheng | 297/174 CS |
| 6,349,654 | B1 | * | 2/2002 | Peters | 108/26 |
| 6,578,496 | B2 | | 6/2003 | Guard et al. | |
| 6,581,210 | B2 | | 6/2003 | Kaloustian | |
| 6,679,549 | B2 | * | 1/2004 | Catelli | 297/174 CS |
| 6,851,375 | B2 | | 2/2005 | Guard et al. | |
| 6,910,429 | B1 | * | 6/2005 | Matay et al. | 108/44 |
| 6,920,830 | B1 | | 7/2005 | Asbach et al. | |
| 7,303,172 | B2 | | 12/2007 | Rich | |
| 7,318,380 | B2 | | 1/2008 | Guard et al. | |
| 7,490,558 | B2 | | 2/2009 | Asbach et al. | |
| 7,651,161 | B2 | * | 1/2010 | Anselmi et al. | 297/174 CS |
| 7,716,749 | B2 | | 5/2010 | Perazzo | |
| 7,871,125 | B2 | | 1/2011 | Asbach et al. | |
| 7,931,245 | B2 | | 4/2011 | Mills, Sr. et al. | |
| 7,950,335 | B1 | * | 5/2011 | Almond et al. | 108/152 |
| 7,992,714 | B1 | * | 8/2011 | Devault et al. | 108/26 |
| 8,151,370 | B2 | | 4/2012 | Perazzo | |
| 8,820,548 | B2 | * | 9/2014 | Wilson | 108/25 |
| 2001/0035112 | A1 | | 11/2001 | Guard et al. | |
| 2002/0004945 | A1 | | 1/2002 | Kaloustian | |
| 2004/0245146 | A1 | | 12/2004 | Kulp, III et al. | |
| 2005/0263038 | A1 | | 12/2005 | Asbach et al. | |
| 2006/0006181 | A1 | | 1/2006 | Rich | |
| 2008/0149580 | A1 | | 6/2008 | Hill | |
| 2010/0176626 | A1 | | 7/2010 | Centracco et al. | |
| 2012/0097683 | A1 | | 4/2012 | Giabanis | |
| 2012/0223040 | A1 | | 9/2012 | Starr et al. | |

* cited by examiner

TRAY DEVICE WITH DOCKING STATION

FIELD OF THE INVENTION

The invention relates to a tray device that is used to catch food and/or items that may fall between a surface and a child and directs the food and/or item onto the tray. More particularly, the invention relates to a tray device that may be attached to a surface by means of a clip or docking station, where the tray device catches and directs food and/or items dropped by the child onto the tray.

BACKGROUND OF THE INVENTION

Trays that are used to catch spilled items are known in the art. For example, TV trays have been used for many years on which a user may place items and may have an edge that is raised such that if liquid is spilled on the tray, it will not run off onto the floor or the user. Likewise, trays that attach to highchairs for children are typically provided with an edge that is raised so as to catch liquid in the tray or retain items within reach of the child. Additionally, trays that attach to a highchair are typically provided of a molded plastic shaped to retain spilled items therein. Further, such trays may selectively be slid (e.g. adjusted) closer to or further away from the baby as desired.

However, a drawback of current tray systems is that the trays do not closely form to the child such that food and/or items often fall between the tray surface and the child. Highchairs provide for some adjustability in that the distance between the tray and the child may be selected from one of a plurality of positions. However, this adjustability does not solve the above-listed problem because the tray is not closely molded to the child.

Another drawback of current tray systems is that they cannot be attached to a variety of table surfaces. For example, TV trays may only be set up adjacent to the surface. Likewise, the trays used in a high chair are attachable only to the arms of the high chair. While it is possible to lay the tray for a high chair on the table surface, the tray is not firmly secured to the surface such that the child or infant may grab/throw the tray, which often results in a mess. Accordingly, if a tray is to be used, typically the highchair must also be brought. However, highchairs are heavy and cumbersome, and often there is no room to place the highchair (e.g. in a restaurant where patrons sit at booths and aisles are kept free).

Another feature common with known trays is that they comprise a substantially rigid tray. In other words, the tray does not move with the child such that, an opening develops between the child and the tray as the child leans forward and/or backward.

It is also known to place a mat on a table surface in front of a child, the mat being provided with a catch or bag positioned between the mat and the child. However, while the bag may be effective in capturing objects dropped, the objects are not redirected onto the surface of the table in front of the child. Additionally, mats are typically formed from a soft, flexible material and are not particularly effective in capturing spilled items (e.g., liquids and items).

SUMMARY OF THE INVENTION

What is desired then is a tray device that will conform to a child's body, such that, food and/or items are substantially prevented from falling between a surface and the child.

It is further desired to provide a tray device that may be firmly connected and/or attached to various surfaces.

It is still further desired to provide a tray device that is relatively light weight and portable and easy to connect to and disconnect from a surface.

It is also desired to provide a tray device that will redirect items that may fall between a child and the table and redirect the item onto the tray surface in direct view of the child.

It further desired to provide a tray device that will closely conform to a child even when the child moves forward and/or backward relative to the tray device such that an item dropped by the child will be directed onto the tray surface in direct view of the child.

These and other objectives are achieved, in one embodiment, by the provision of a tray device that catches food or an item that would usually fall between the table and the child and directs it onto the tray, such that the child can easily pick the item back up again. It is well known that typically children do not have well developed motor skills and often drop items they are holding. This situation results in a lot of work for the parents picking up the vast collection of items dropped by the child during a meal. For meals that occur in a restaurant, the floor surface is quite often not kept entirely clean and food items that are dropped must be discarded resulting in waste. The tray device that extends outwardly toward the child's body is positioned substantially, directly downward from the child's mouth such that, if the child drops the food, it will be caught by the lip of the tray device and directed onto the clean tray surface.

Additionally, the tray acts to protect the table and items placed thereon (e.g. mobile phones, wallets, bags, etc.) from damage due to food and liquid spills. The tray provides a stable surface eating (and/or play) area for the child and helps to keep clothes (both the child's and the parent's) protected from potential food and liquid stains. The tray also provides for a relatively easy clean up due to, in one embodiment, a removable dish washer safe insert.

In one advantageous embodiment a lip of material (e.g., rubber, plastic or other material), protrudes out from the tray towards the child. The lip may be angled (and in one embodiment, flexible) such that, when the child drops an item it is caught by the lip and directed onto the tray surface. When the lip is provided as a flexible lip, when the child leans in toward the tray, the lip moves in with the child and when the child leans away from the tray, the lip moves out with the child to close gaps between the child and the table.

In an alternate embodiment, it is contemplated that the lip may comprise a substantially inflexible hard plastic or other material. In this embodiment, the lip would serve substantially the same purpose as the flexible lip (e.g., catching spills between the child and the table) and may comprise a concave U shape to closely conform to the child's body. This hard lip would be angled out toward the child's body to catch spills while being contoured in such a way as to be comfortable for the child to lean against (e.g. no relatively sharp or pointed edges against the child's body).

It is contemplated that the tray may be provided with a rubber base which grips the table to keep the tray stationary. This base grip material may be formed as feet or small circles, or as strips which would outline the bottom of the tray surface. In order to firmly secure the tray to a variety of different surfaces, it is understood that flexible clips or a docking station may be used.

Also provided is a removable insert tray or plate (insert) may be inserted substantially into the contour of the tray device. The insert is easy to remove (deformable plastic engagement with the tray) and clean separately, for example, in a dishwasher. The insert tray may be provided with either a flexible or solid lip while the under tray might be a solid tray. Alternatively, the under tray may also be provided with or without a flexible or solid lip.

The components of the tray may, in one advantageous embodiment, comprise the following: a base tray (e.g., plastic) with upturned edges on three or four sides and/or part of the fourth side. The fourth side may be provided having a flexible (or non flexible) lip which extends from the tray towards the child. The underside of the tray may be provided with a grip material (e.g., rubber). Additionally, a clip(s) may be molded into the tray forming an attachment system. In one embodiment, the attachment system may comprise a clamp (e.g. a spring wound alligator type clamp) that is provided with a surface having rubber grip (or a series of grips) to provide a secure attachment to the surface.

Alternatively, the attachment system may be provided such that a base clip or docking station is attached to a table or other eating surface, and the tray snaps into the base docking station. The tray could then snap into the base unit that is clipped, screwed or fastened onto the eating table.

The purpose of the docking station is to secure the tray to a table in an efficient and safe manner. In the docking station embodiment, the docking station is provided with essentially two parts: 1) the portion of the station that affixes to the table; and 2) the portion that engages with the tray.

The first portion of the docking station is provided to attach to a table or eating surface by means of, for example: a clip; or a screw or vice-like mechanism, and the like. This attachment mechanism is part of the docking station allowing it to be secured to a surface. In the screw or vice version, a handle, or wheel may be turned facilitating opening/closing of the clip or vice.

The second portion of the docking station includes a portion (e.g., square flat seat-belt like piece) that sits on the surface and may, in one embodiment, be approximately 2"×2" or 3"×3" length/width and 3/16" height. It would serve as the snap in area for the tray to snap into. We envision this part either being a Tupperware like snap in device or a seatbelt like snap in with a female and male part.

The components may be arranged and function together as follows: The base of the tray has grip material that helps to secure the tray to a surface. The Tray has a clip, clips, or a docking station which may attach to the rim of a table or other surface and secure the tray in place. The tray functions as, for example, an eating/play surface area. The insert tray may drop into the under tray providing a surface for the child to eat on that is easily removable and is dishwasher safe. The lip is provided as a permanent feature of the tray extending up at an angle toward the child. Where the lip is provided as a flexible lip, as the child leans in and out the lip flexes against the child in order to seal gaps between the child and the table and catch food and liquids. The lip is shaped in a manner to provide the most effective "catching" possible while at the same time being comfortable for the child to lean against. The tray may be left on the table and wiped down, or it can be removed and cleaned in the sink. It is removed by releasing the clips.

It is contemplated that the insert may be provided for use with the tray that attaches to a surface as described above, or may be used with conventional high chairs achieving substantially the same result of redirecting items that may fall back onto the tray or insert surface away from the child. The flexible lip may also be utilized in a different application where it is separately used on its own to attach to conventional height chairs, with the same intention of catching food which spills in between the tray and the child, bringing food back to the tray.

For this application the following terms and definitions shall apply:

The terms "first" and "second" are used to distinguish one element, object or thing from another, and are not used to designate relative position or arrangement in time.

The terms "coupled", "coupled to", "coupled with", "connected", "connected to", and "connected with" as used herein each mean a relationship between or among two or more devices, apparatus, components, systems, subsystems, and/or means, constituting any one or more of (a) a connection, whether direct or through one or more other devices, apparatus, components, systems, subsystems, or means, and/or (b) a functional relationship in which the operation of any one or more devices, apparatus, components, systems, subsystems, or means depends, in whole or in part, on the operation of any one or more others thereof.

In one embodiment, a tray device is provided that is detachably connectable to a structure having a substantially flat upper surface. The tray device comprises an attachment mechanism formed as a docking station and having a C-clamp having an upper portion that engages directly with the upper surface of the structure the tray device is to be connected to and a lower portion that engages directly with a lower surface of the structure such that the structure is sandwiched directly between the upper portion and the lower portion, said upper portion having formed integral therein at least two undercuts. The tray device further comprises a base portion having a footprint, the base portion having an upper area with upturned peripheral edges and having at least two protrusions that engage with the at least two undercuts on the docking station such that the base portion is detachably connectable to the docking station forming a detachable mechanical connection between said docking station and said base portion. The base portion is provided such that it engages with the upper surface of the structure, wherein when the base portion is attached to the docking station, the base portion sits substantially flat relative to the upper surface of the structure such that the upper surface of the structure provides support to the base portion.

Other objects of the invention and its particular features and advantages will become more apparent from consideration of the following drawings and accompanying detailed description.

DETAILED DESCRIPTION OF THE INVENTION

Figure 1A:
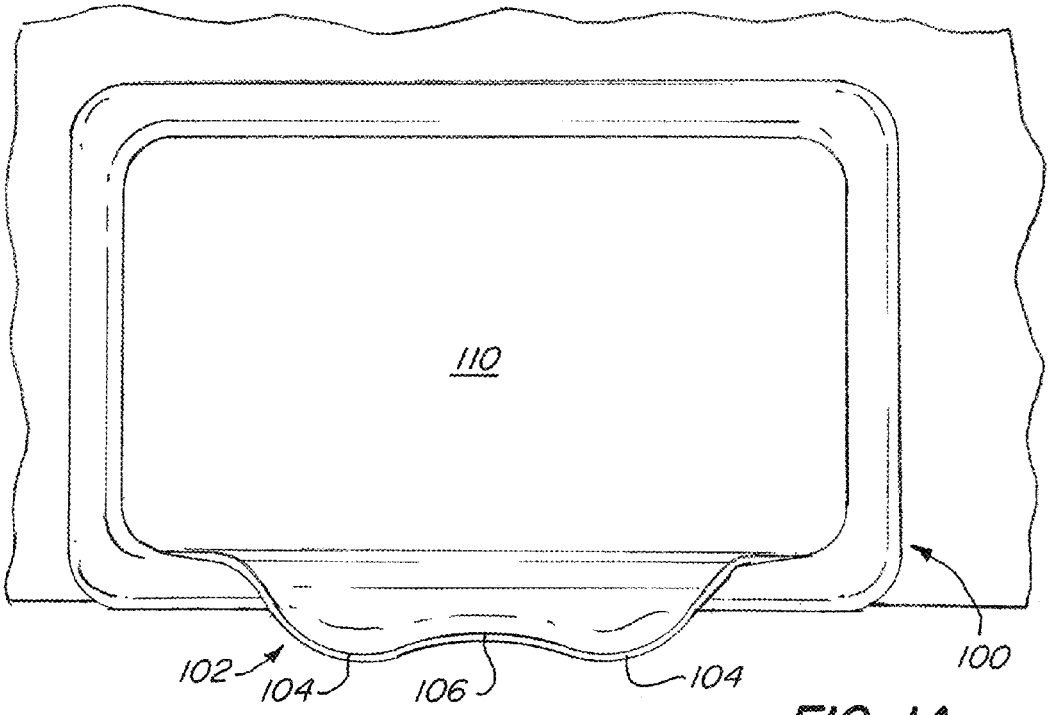
FIG. 1A is a top view of one advantageous embodiment of the invention.

Referring now to the drawings, wherein like reference numerals designate corresponding structure throughout the views.

The following examples are presented to further illustrate and explain the present invention and should not be taken as limiting in any regard, but rather provide exemplary embodiments of the invention.

FIG. 1A is a top view of one advantageous embodiment of the present invention showing a tray 100 measuring, for example, 10 inches deep by 16 inches wide. The tray 100 may be provided as a hard plastic material having a lip 102 that extends outwardly to closely conform to the child's body. The lip may be forms of two extensions 104 forming a concave section 106 therebetween.

Figure 2A:
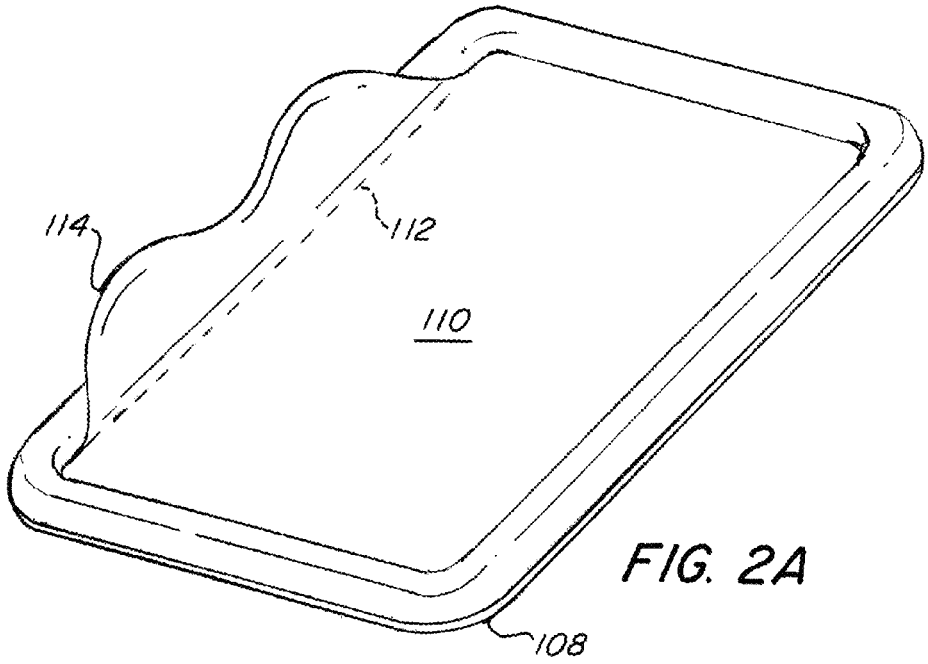
FIG. 2A is a perspective view of the advantageous embodiment according to FIG. 1A.
Figure 3:
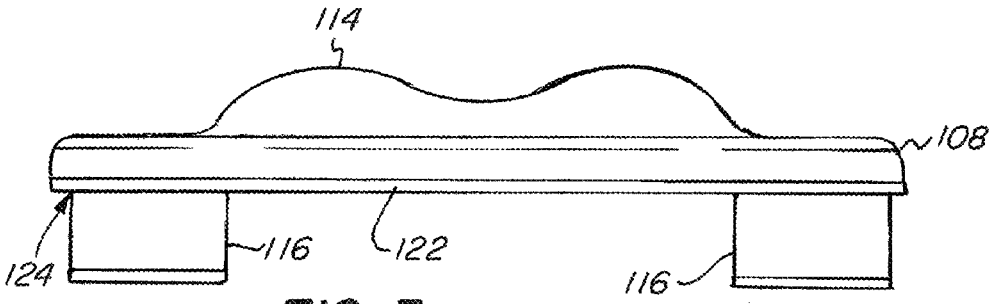
FIG. 3 is a front view of the advantageous embodiment according to FIG. 1A.

Referring to FIGS. 2A and 3, the lip 102 may extend both outwardly toward the child's body and upward from a base portion 108 of the tray 100, such that, items dropped by a child are "caught" by the lip and directed onto the tray surface 110.

It is contemplated that, in one embodiment, the tray surface 110 and the lip 102 may be provided as a single integrally formed structure with the lip extending from a point 112 along the tray surface 110 upward to terminate at a lip edge 114. The lip edge 114 may be provided with a rounded contour so as to provide a relatively comfortable surface against, which the child may lean.

Also illustrated in FIG. 3 is attachment mechanism 116, which may be provided in the form of a clip to engage with an edge of a table (not shown) to affix the tray 100 to the table.

Figure 4:
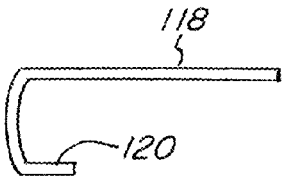
FIG. 4 is a side view of a clip.
Figure 5:
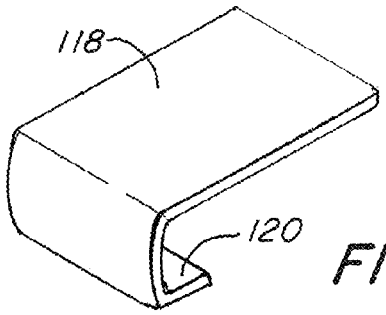
FIG. 5 is a perspective view of the clip according to FIG. 4.

FIGS. 4 and 5 illustrate one example of the attachment mechanism 116 shown as clips having, for example, but not limited to, an upper portion 118 length of 4½ inches, a width of 3 inches, a height of about 2 inches and an under portion 120 length of about 1 inch. It is understood that the clips may be either removable or non-removable from the underside 122 of the tray 100. For example, the upper portion 118 of the clip may be inserted into a cavity 124 located on the underside 122 of the tray 100. In one embodiment, the clips are provided as a plastic or steel with a rubber coating such that they may securely hold the tray to a surface and not scratch or damage the surface.

Figure 1B:
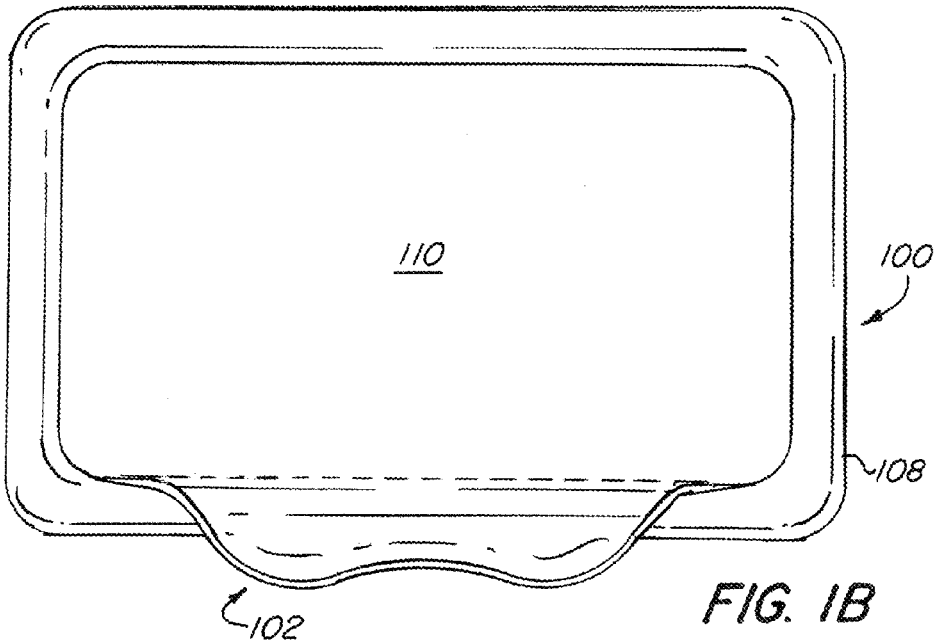
FIG. 1B is a top view of another advantageous embodiment of the invention.
Figure 2B:
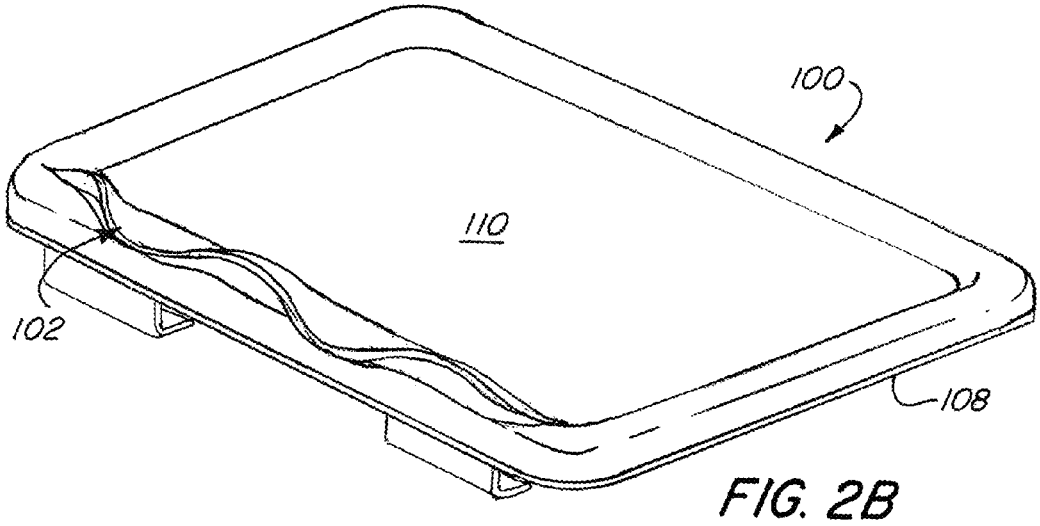
FIG. 2B is a perspective view of the advantageous embodiment according to FIG. 1B.
Figure 6A:
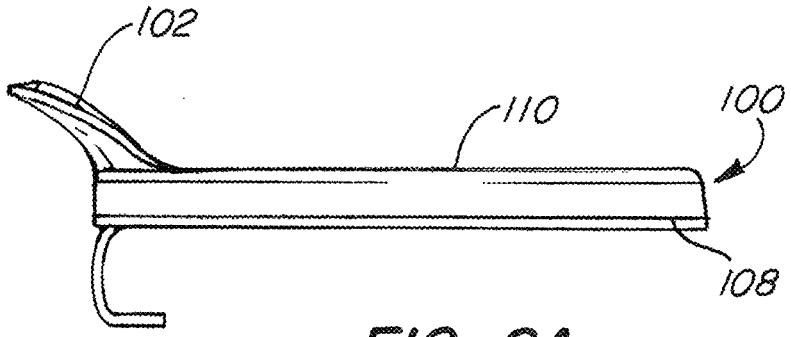
FIG. 6A is a side view of the advantageous embodiment according to FIG. 1B.

FIG. 1B illustrates an alternative embodiment showing a tray 100 that includes a lip 102 similar to that disclosed in connection with FIG. 1A, however, the lip 102 comprises a substantially flexible material that may move with the child as the child leans in toward and away from the tray. As seen in FIGS. 2B and 6, the flexible lip 102 may extend outward from the tray base portion and upward relative to the tray surface 110 of the base portion 108.

In both of the embodiments in FIGS. 1A and 1B, it is contemplated that the underside of the base portion 108 may be provided with a non-skid material (e.g. rubber or other suitable material that will work to prevent the tray 100 from sliding laterally across the surface) to engage with the table surface (not shown). The non-skid material may cover substantially the entire surface of the underside of the tray or only a portion thereof. Additionally, the non-skid material may comprise raised ridges in the manner depicted in connection with FIG. 13.

Figure 2C:
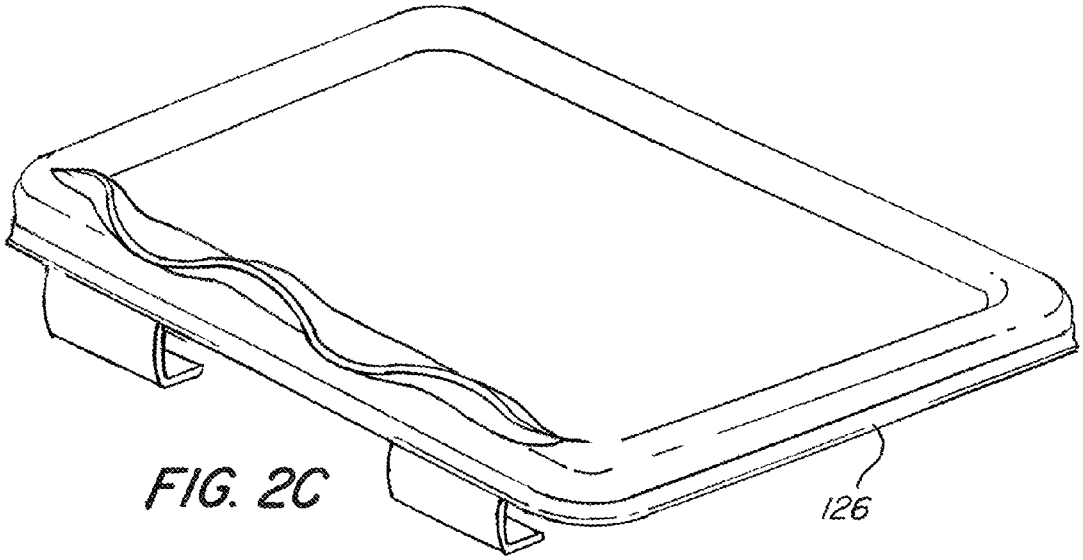
FIG. 2C is a perspective view of still another advantageous embodiment of the invention.
Figure 6B:
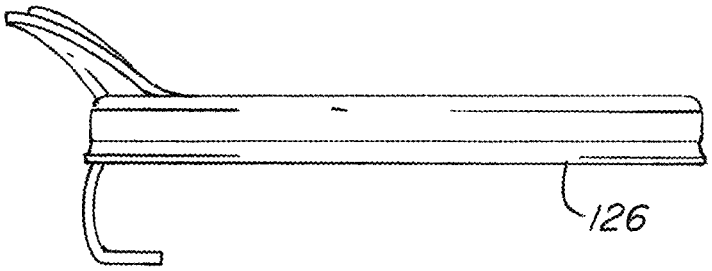
FIG. 6B is a side view of the advantageous embodiment according to FIG. 2C.
Figure 7:
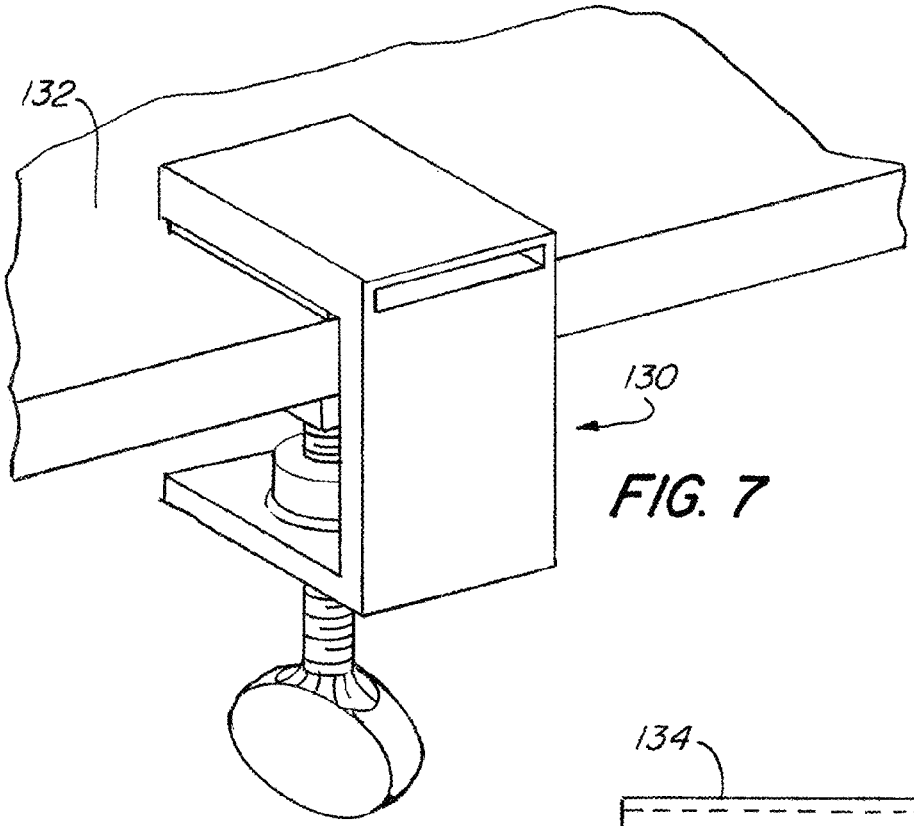
FIG. 7 is an illustration of a docking station affixed to a surface, which may be used in connection with the embodiments of 1A-1C.
Figure 8:
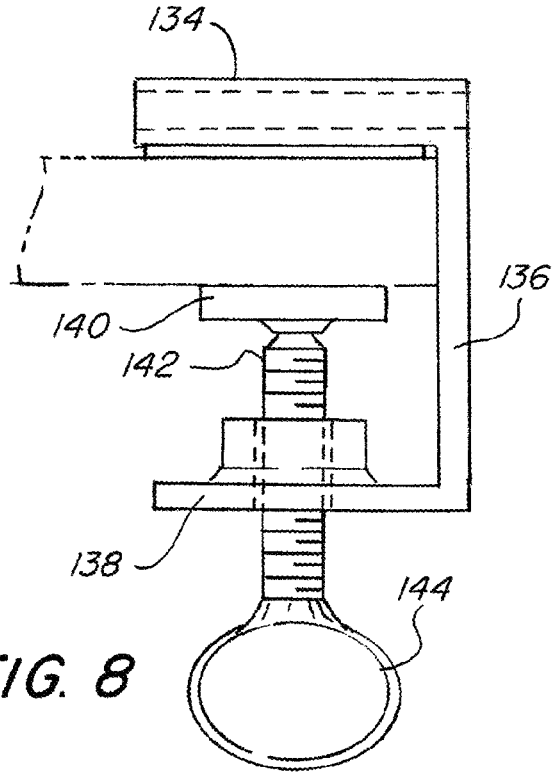
FIG. 8 is a side view of the docking station according to FIG. 7.

FIGS. 2C and 6B illustrate still another embodiment in which the lip 102 may comprise either a flexible or rigid material, however, the base portion 108 is provided with a raised rubber seating 126 that extends circumferentially (or at least or portion thereof) around the base portion 108. In this manner, the tray may sit on a surface by means of the raised rubber seating 126.

Referring now to FIGS. 7-10, the attachment mechanism 116 is provided as a docking station 130, and may be used to affix the tray 100 to a surface 132. The docking station may comprise, in one embodiment, but is not limited to, a C-clamp arraignment, having an upper portion 134, a vertical portion 136, a lower portion 138 and a clamping portion 140. The clamping portion 140 is connected to the lower portion 138 by means of a screw 142 such that by rotation of the knob 144, the clamping portion is moved upward toward the upper portion 140 sandwiching the surface 132 therebetween.

Figure 9:
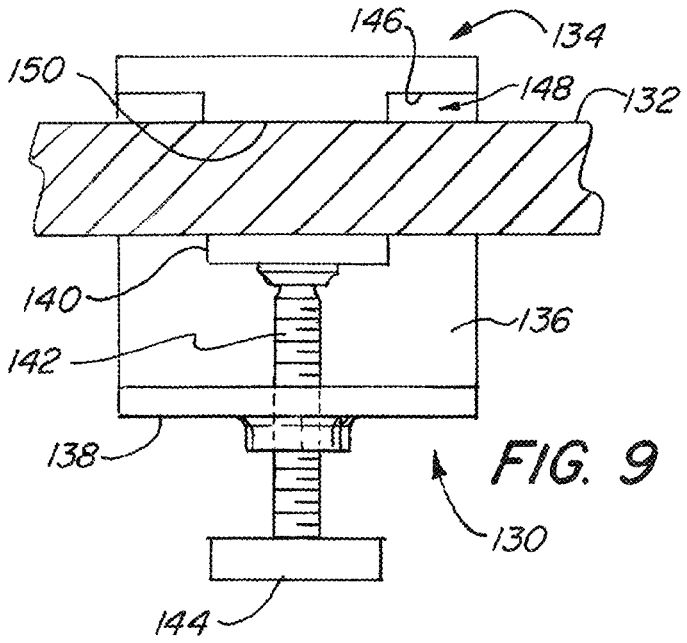
FIG. 9 is an end view of the docking station according to FIG. 7.
Figure 10:
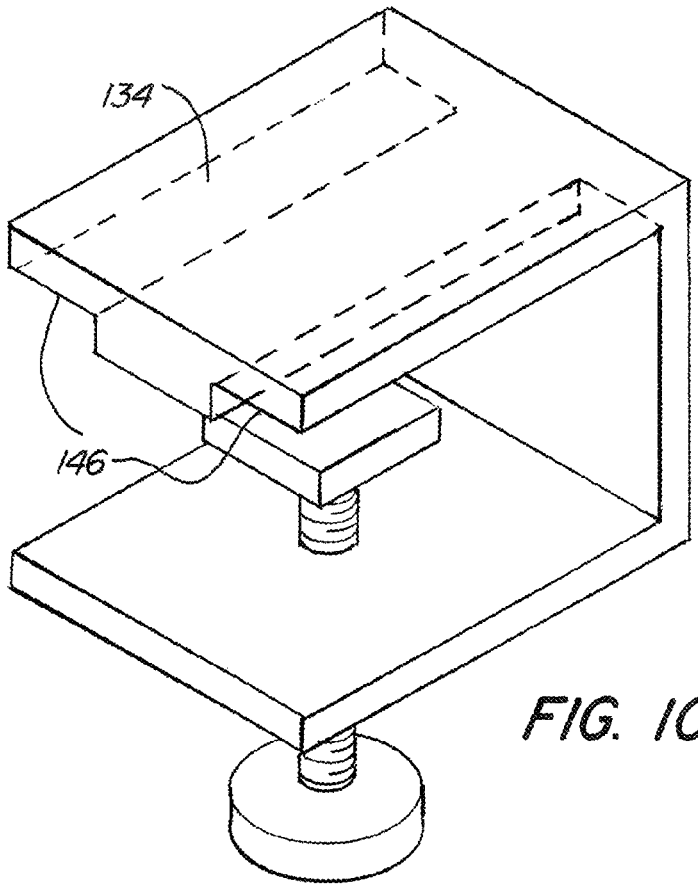
FIG. 10 is a perspective view of the docking station according to FIG. 7.

In particular, FIGS. 9 and 10 illustrate one embodiment of the docking station. The upper portion 134 is provided with an undercut 146 such that a space 148 is formed on either side of the lower surface 150 of upper portion 134 that engages with the surface 132.

Figure 11:
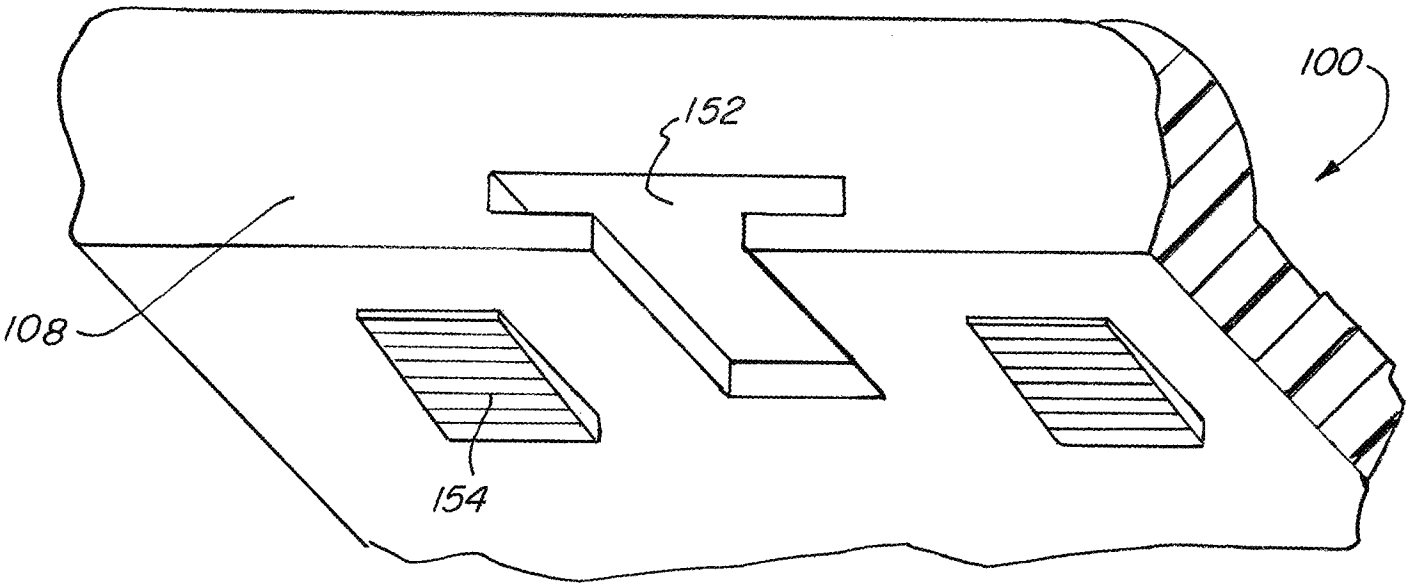
FIG. 11 is an illustration of the connection mechanism on the tray for connecting to the docking station according to FIG. 7.

FIG. 11 illustrates a cavity 152 formed in the base portion 108 of tray 100. The cavity 152 is formed as a female portion to engage with the undercuts 146 of docking station 130 to firmly affix the tray to the surface 132. Also shown in FIG. 11 is foot 154, which comprises a non-skid material. As previously discussed, the non-skid material may also substantially cover the entire surface of the underside of the tray 100.

Figure 12:
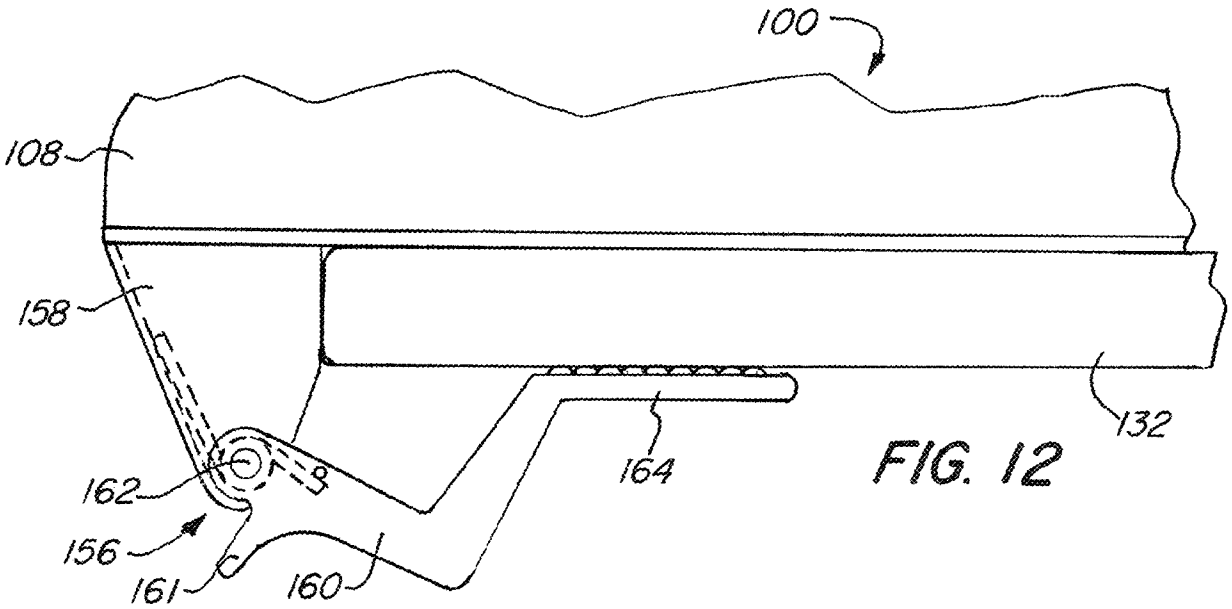
FIG. 12 is a side view of an embodiment according to FIGS. 1A-1C.
Figure 13:
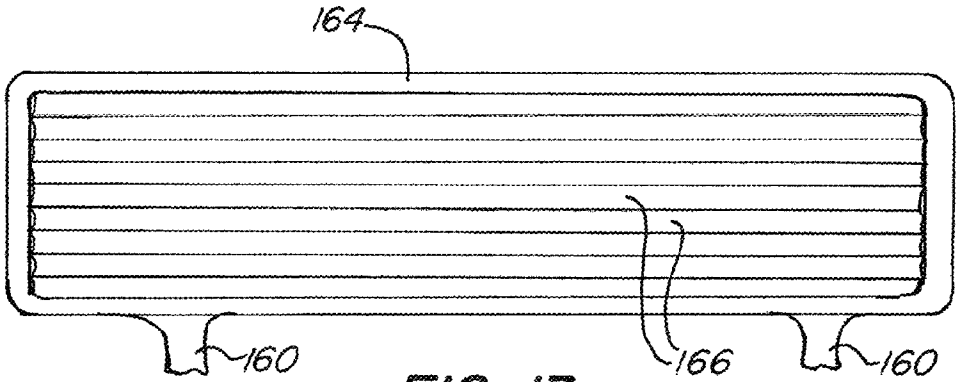
FIG. 13 is an end view of the attachment surface according to FIG. 12.

FIG. 12 illustrates still another embodiment of the present invention wherein the attachment mechanism 116 comprises a clamp 156. The clamp 156 includes an extension 158 positioned on an underside of the base portion 108. The extension 158 is connected to an arm 160 by means of a pivoting joint 162, which may comprise a biasing member to bias the arm toward the underside of the base portion 108. The arm 160 terminates at a distal end with a gripping surface 164, which is designed to engage with an underside of surface 132 such that surface 132 is sandwiched between the underside of base portion 108 and the gripping surface 164. The underside of base portion 108 may be provided as any configuration described herein so as to substantially prevent the tray 100 from sliding laterally away from surface 132. With reference to FIG. 12, the gripping surface 164 is provided at an angle to maximize the surface contact with the underside of the surface 132. FIG. 13 depicts one advantageous embodiment of gripping surface 164 is provided as a rubber material (or any other suitable material that will present a coefficient of friction sufficient to resist lateral movement of the tray 100)

having raised portions 166. It is contemplated that any number of raised portions 166 may be provided and the size of the gripping surface can be selected to present the desired resistance to lateral slipping. Likewise, it is contemplated that the biasing member in the pivoting joint 162 may be selected to provide a desired biasing force for arm 160 sufficient to resist lateral slipping of the tray 100. Also shown in FIG. 12 is disengagement member 161, which is provided to allow a user to depress disengagement member 161 to overcome the bias allowing the tray 100 to be disengaged from surface 132.

Figure 14:
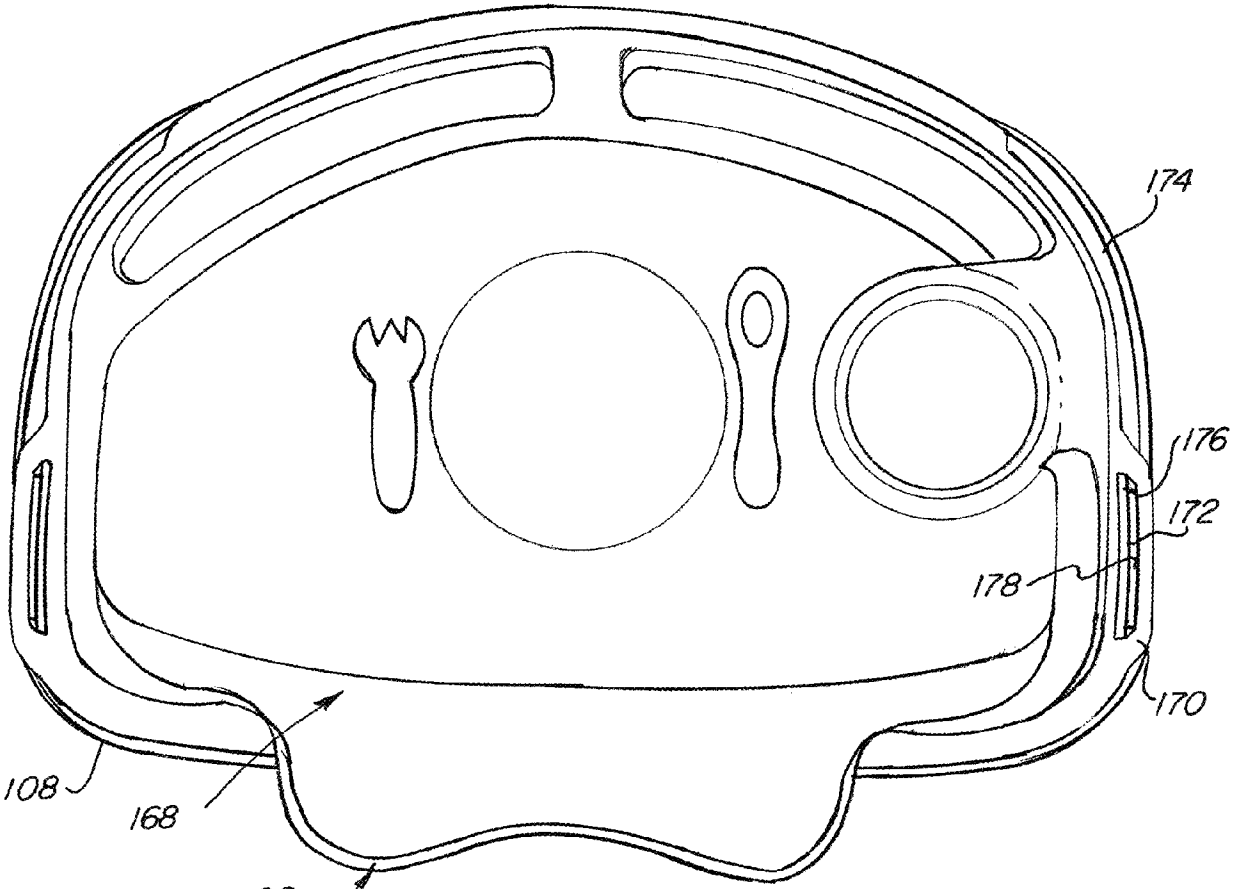
FIG. 14 is a top view of the insert according to FIGS. 1A-1C.
Figure 15:
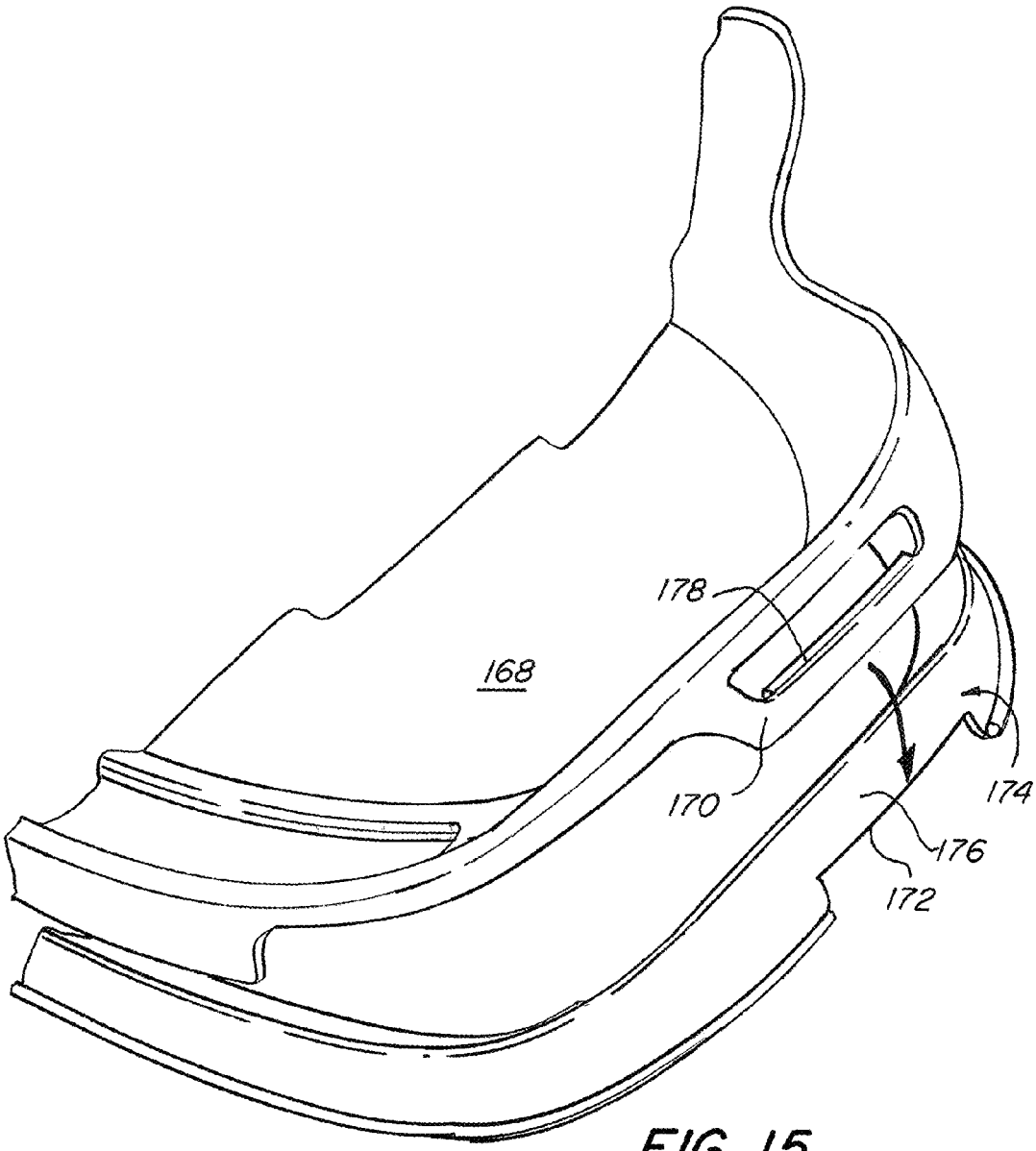
FIG. 15 is a perspective view of the insert attached to the under tray according to FIG. 14.

FIGS. 14 and 15 depict an insert 168 that may be slid over or onto base portion 108. In one embodiment, the insert 168 is fastened to the base portion 108 by means of a mechanical interlock, where a handle 170 is slid over and engages with an undercut 172 provided in a side 174 of base portion 108 (FIG. 15). It is contemplated that handle 172 is formed of a deflectable plastic material such that the handle may be deflected outward and over the shoulder 176 and the handle engagement surface 178 engages with undercut 172. The insert is removable such that it may be clean and re-attached to the base portion 108.

Also shown in FIG. 14 are various designs molded into the insert of, for example, a fork, a plate, a spoon and a holder for a cup. These are provided to teach the child the correct placement of utensils for a table setting. It should be understood that virtually any type of design can be provided on the surface of the insert 168. Likewise, it is contemplated that the insert may be selected from many different colors, which will work to get the attention of the child.

In still another embodiment, it is contemplated that the lip 102 may be provided on the base portion 108, the insert 168 or both. Additionally, it is contemplated that the lip 102 may be provided as either a flexible or non-flexible material. Many alternative arrangements of the tray 100 are conceived in which a tray 100 with a lip 102 is attachable to a surface 132 and the forgoing examples are provided as exemplary and are not intended to be limiting.

Figure 16:
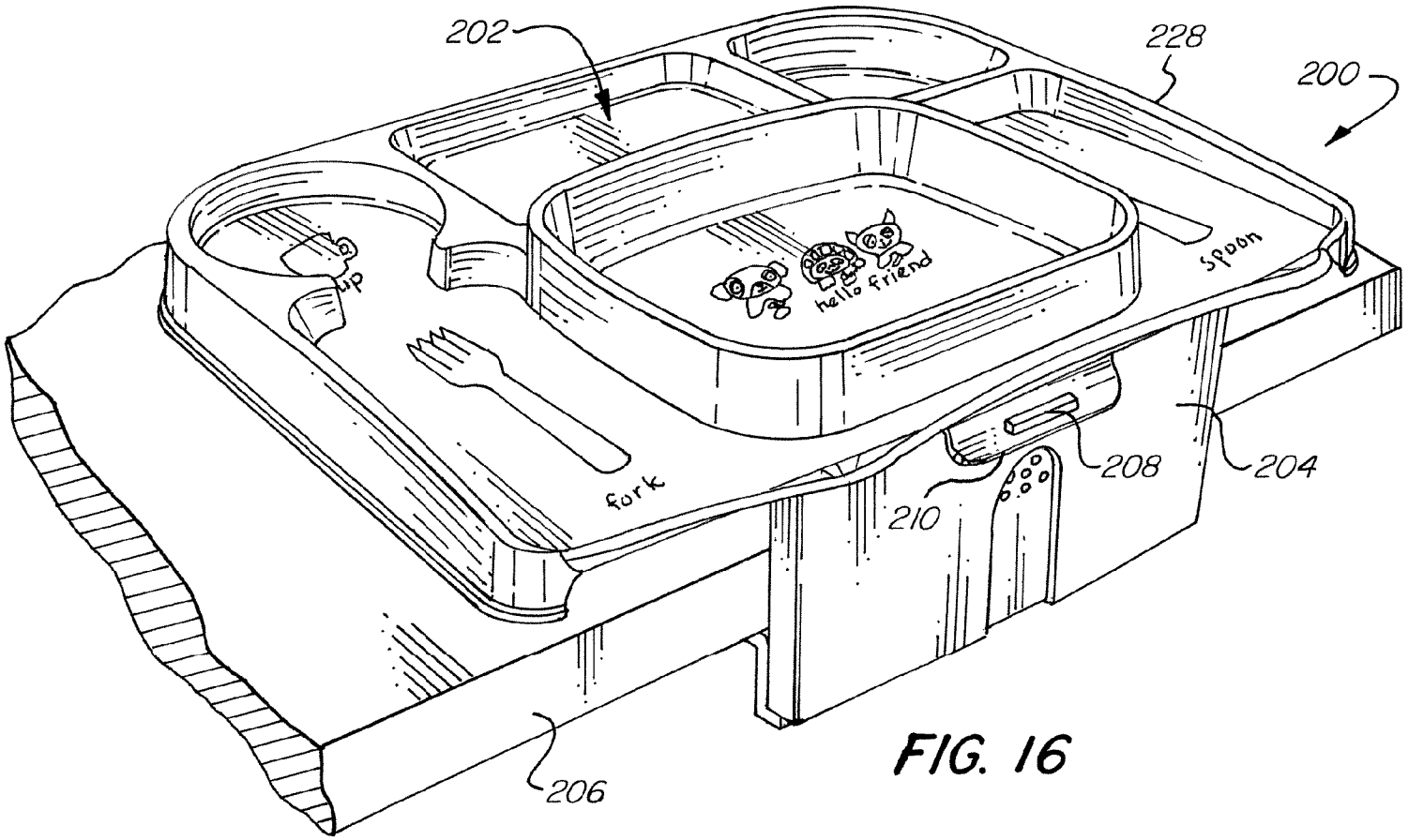
FIG. 16 is a top perspective view of an advantageous embodiment of the invention.
Figure 17:
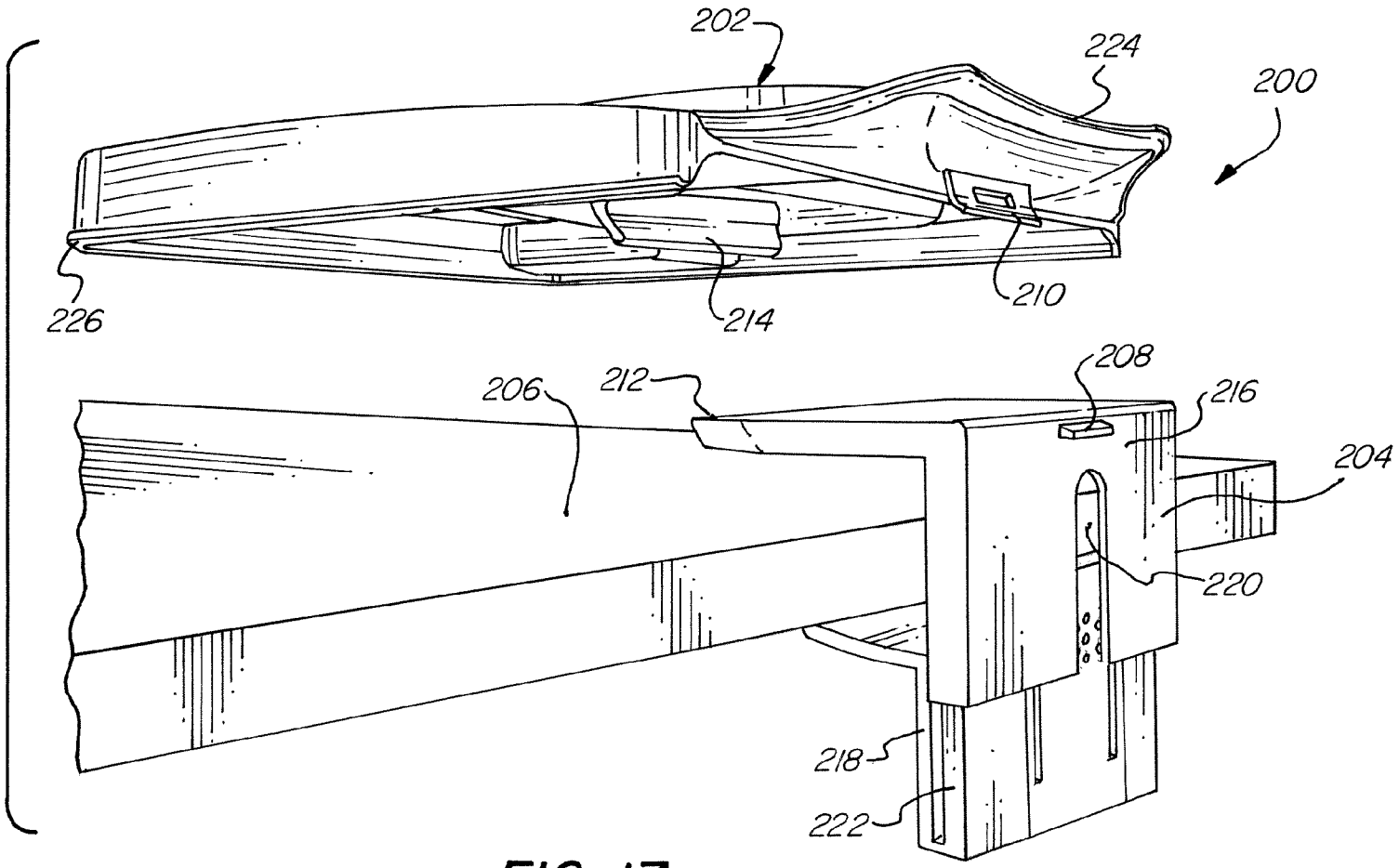
FIG. 17 is a side perspective view of the embodiment according to FIG. 16.
Figure 18:
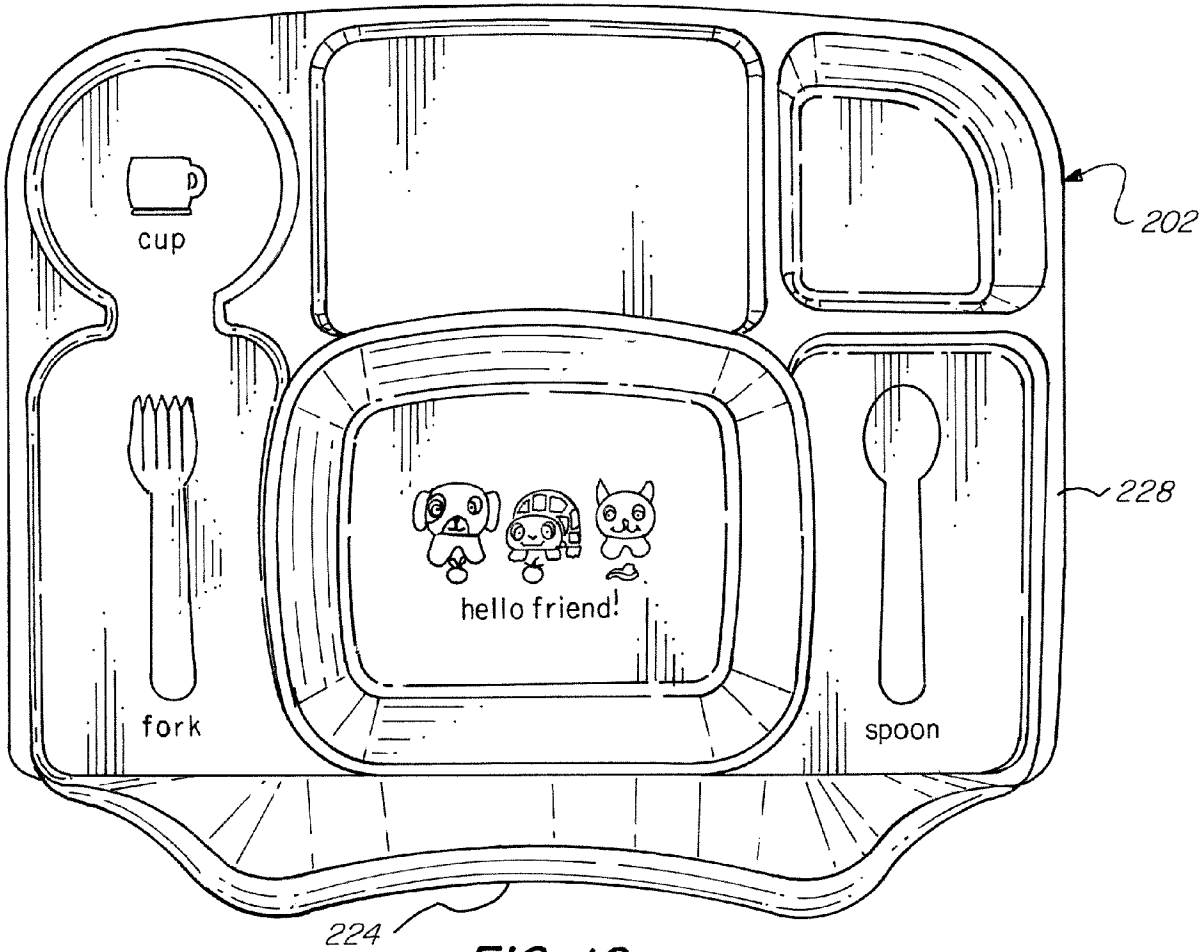
FIG. 18 is a top view of the embodiment according to FIG. 16.

Referring now to FIGS. 16-18 another embodiment of tray device 200 is depicted. As seen in FIG. 16, base portion 202 sits on docking station 204, which is attached to a surface 206. The docking station is provided with an L-Shaped upper portion 216 and an L-Shaped lower portion 218. The upper portion 216 is provided with a cavity 220 located therein to receive an insertion section 222 such that the docking station 204 is formed as a clamp. To connect the docking station 204 to surface 206 a ratcheting system is provided in the docking station 204 such that to connect the docking station to the surface 206, one only has to squeeze the C-clamp arraignment closed and the docking station sandwiches the surface 206 between the upper portion 216 and the lower portion 218.

The docking station 204 is also provided with a protrusion 208 that engages with an undercut 210 located on the base portion 202. A second protrusion 212 on docking station 204 (FIG. 17) is also engagable with a second undercut 214 on base portion 202. To affix the base portion 202 to the docking station 204 first the protrusion 212 is engaged with the undercut 214 on the underside of the base portion 202, then the rear of the base portion 202 is pushed downward towards the docking station 206 such that the protrusion 208 engages with the undercut 210. In practice, the undercut 210 will deform outwardly as the user pushed down on the base portion 202 and will then snap back into place once past the protrusion 208 such that the base portion 202 is securely held to the docking station 204.

The ratcheting system of the docking station 204 can be disengaged by a user pushing on the insertion section 222 and pulling downward allowing the lower portion 218 to move downward and away from the upper portion 216. Likewise, the base portion 202 can be detached from the docking station 204 by a user lifting up on the undercut 210 to deform it outwardly so that the undercut 210 can be lifted over the protrusion 208.

It should be understood that the tray device 200 may be made of any of the materials previously discussed herein. Likewise, the base portion 202 is provided with a lip 224 that may be formed and function as previously described herein.

The base portion 202 is further provided with a lower edge portion 226 that is designed to sit flat on the surface 206 to provide support for the base portion 202.

The base portion 202 is still further provided with upturned peripheral edges 228 (FIGS. 16 & 18) that are designed to catch any spills or food that the child may drop, thereby capturing it to keep the child and area clean. Also as can be seen with reference to FIGS. 16 & 18 that various locations on the base portion 202 are identified for the child including a location for a fork, a spoon and a cup. Various depressions are also provided allowing the base portion 202 to function as a bowl for the child.

While not depicted in FIGS. 16-18, is will be understood that an insert as previously described herein may be usable with the tray device 200.

The invention has been described with reference to a particular arrangement of parts, features and the like, these are not intended to exhaust all possible arrangements or features, and indeed many other modifications and variations will be ascertainable to those of skill in the art.

What is claimed is:

1. A tray device that is detachably connectable to a structure having a substantially flat upper surface comprising:

an attachment mechanism formed as a docking station and having a C-clamp having an upper portion that engages directly with the upper surface of the structure the tray device is to be connected to and a lower portion that engages directly with a lower surface of the structure such that the structure is sandwiched directly between the upper portion and the lower portion, said upper portion having formed integral therein at least two undercuts;

a base portion having a footprint, said base portion having an upper area with upturned peripheral edges;

said base portion further having at least two protrusions that engage with the at least two undercuts on the docking station such that the base portion is detachably connectable to the docking station forming a detachable mechanical connection between said docking station and said base portion;

said base portion engaging with the upper surface of the structure, wherein when the base portion is attached to the docking station, the base portion sits substantially flat relative to the upper surface of the structure such that the upper surface of the structure provides support to the base portion.

2. The tray device according to claim 1 wherein said upper area extends upwardly and outwardly from one of said upturned peripheral edges to form a lip.

3. The tray device according to claim 1 wherein said base portion is provided with a raised seating that extends at least partially around a circumference of said base portion such that the base portion engages with the upper surface of the structure by means of the raised seating.

4. The tray device according to claim 1 wherein said docking station comprises an upper portion and a lower portion and the upper portion has a cavity located therein for receiving an insertion section of the lower portion, wherein the docking station is affixed to the surface when the lower portion and the upper portion are moved toward each other.

5. The tray device according to claim 4 wherein said docking station comprises a ratcheting system.

6. The tray device according to claim 5 wherein the ratcheting system is released by a user pushing inward on the lower portion relative to the upper portion to disengage the ratcheting system.

7. The tray device according to claim 1 wherein said docking station comprises an upper portion formed as an L-shape and one of said at least two undercuts is positioned at an end of the upper portion and the other of said at least two undercuts is positioned at an elbow of the upper portion, and the at least two protrusions are positioned on an underside of said base portion and respectively engage with the at least two undercuts.

8. The tray device according to claim 1 further comprising a removable insert that is attachable to said base portion.

9. The tray device according to claim 1 wherein said base portion includes a bowl integrally formed therein.

10. The tray device according to claim 1 wherein said base portion includes pictures formed therein for a child's entertainment.

11. The tray device according to claim 1 wherein said base portion includes indications for therein selected from the group consisting of: a fork, a spoon, a cup and combinations thereof.

12. The tray device according to claim 1 wherein said base portion and said docking station are formed of a plastic material.

* * * * *